United States Patent [19]

Salomon

[11] Patent Number: 5,051,198

[45] Date of Patent: Sep. 24, 1991

[54] ANTI-OXIDANT COMPOSITIONS CONTAINING MERCAPTOTHIADIAZOLE OR MERCAPTOBENZOTHIAZOLE DERIVATIVES

[75] Inventor: Mary F. Salomon, Cleveland Heights, Ohio

[73] Assignee: The Lubrizol Corporation, Wickliffe, Ohio

[21] Appl. No.: 461,136

[22] Filed: Jan. 4, 1990

Related U.S. Application Data

[63] Continuation of Ser. No. 188,589, Jun. 24, 1988, Pat. No. 4,894,174, which is a continuation of Ser. No. 60,183, Jun. 9, 1987, Pat. No. 4,764,299.

[51] Int. Cl.[5] ..... C10M 133/38

[52] U.S. Cl. ..... 252/47; 252/78.1; 568/21; 568/25; 548/186

[58] Field of Search ..... 568/21, 25; 548/186; 252/47, 78.1

[56] References Cited

U.S. PATENT DOCUMENTS

| | | | |
|---|---|---|---|
| 2,230,966 | 2/1941 | Reid | 252/45 |
| 2,467,713 | 4/1949 | Watkins | 568/21 |
| 2,582,605 | 1/1951 | Richter et al. | 568/46 |
| 2,874,192 | 2/1959 | Cottle et al. | 252/48.2 |
| 3,135,804 | 6/1964 | von Brachel et al. | 252/48.2 |
| 3,335,189 | 8/1967 | Degener et al. | 252/48.2 |
| 3,426,075 | 2/1969 | Campbell | 252/45 |
| 3,450,771 | 6/1969 | Dombro | 568/38 |
| 3,463,783 | 8/1969 | Strauss et al. | 568/186 |
| 3,627,794 | 12/1971 | Grimm et al. | 568/21 |
| 4,031,023 | 6/1977 | Musser et al. | 252/48.2 |
| 4,069,259 | 1/1978 | Cipris et al. | 568/21 |
| 4,217,233 | 8/1980 | Michaelis | 252/48.2 |
| 4,366,307 | 12/1982 | Singh et al. | 568/44 |
| 4,615,818 | 10/1986 | DiBiase et al. | 252/48.2 |
| 4,764,299 | 8/1988 | Salomon | 252/48.2 |

OTHER PUBLICATIONS

"The Condensation of 2-Hydroxyethylsulfides with Alcohols and Phenols", Richter et al., Journal of Polymer Science, vol. XLI, pp. 4076-4079.

"Thioglycol Polymers I Hydroclaric Acid-Catalyzed Auto Condensation of Thiodiglycol", Woodward, Journal of Polymer Science, vol. XLI, pp. 219-223, (1959).

"Thioglycol Polymers III Copolymerization of Thiodiglycol and Similar Thioglycas W/Aliphatic Hydroxy Compounds", Andrews et al., Journal of Polymer Science, vol. XLI, pp. 231-239 (1959).

Nucleophilic Substitution of Hydroxyl Groups in 2-Alkyl (Aryl) Thioethanols, Published by Fokin, et al., in the Bull. Acad. Sci., U.S.S.R. Div. Chem. Sci., 1982, p. 1667.

*Primary Examiner*—Prince E. Willis
*Assistant Examiner*—Ellen McAvoy
*Attorney, Agent, or Firm*—James L. Cordek; Forrest L. Collins; Joseph P. Fischer

[57] ABSTRACT

The present invention deals with compositions containing sulfur and oxygen which are useful in lubricants and automatic transmission fluids.

7 Claims, No Drawings

ANTI-OXIDANT COMPOSITIONS CONTAINING MERCAPTOTHIADIAZOLE OR MERCAPTOBENZOTHIAZOLE DERIVATIVES

This is a continuation of co-pending application Ser. No. 07/188,589 filed on June 24, 1988, now U.S. Pat. No. 4,894,174 issued Jan. 16, 1990, which is a continuation of Ser. No. 060,183 now U.S. Pat. No. 4,764,299 issued Aug. 16, 1988.

BACKGROUND OF THE INVENTION

I. Field of the Invention

The present invention relates to compositions which are useful as anti-oxidants, and in particular, for antioxidants used in lubricants.

II. Description of the Art

It is known from an article entitled *The Condensation of 2-Hydroxyethylsulfides with Alcohols and Phenols* by Richter et al, Journal of Polymer Science, Volume XLI, Pages 4076–4079, that a beta-dithiodialkanol when reacted in the presence of hydrochloric acid and an alcohol will give the corresponding ether as a reaction product. The technology in the Richter article is further reported in U.S. Pat. No. 2,582,605 issued Jan. 15, 1952.

It is suggested in German published patent application 1,520,040A that Guerbet alcohols may be condensed with thiodialkylols at a molar ratio of 1:0.5–0.9. U.S. Pat. No. 4,366,307 issued Dec. 28, 1982 to Singh et al describes non-crystallizing, water, solvent, fuel and temperature resistant liquid polythioethers having 2–4 terminating radicals and at least 8 repeating sulfur-containing units.

Reid, in U.S. Pat. No. 2,230,966, issued Feb. 4, 1941, describes compositions which are alkylthio diethylsulfides. Reid states these materials may be used in lubricants and particularly as transformer fluids.

Further information with regard to the polymerization of a beta-thiodialkanol is found in *Thioglycol Polymers I Hydrochloric Acid-Catalyzed Auto Condensation of Thiodiglycol* by Woodward, Journal of Polymer Science, Volume XLI, Pages 219–223 (1959). The hydroxyl groups in the beta position relative to the sulfur in an aliphatic chain are stated to be of unusual reactivity in the Woodward article. Further information on such beta-dialkanols is found in *Thiogylcol Polymers III Copolymerization of Thiodiglycol and Similar Thioglycols with Aliphatic Hydroxy Compounds* by Andrews et al, Journal of Polymer Science, Volume XLI, Pages 231–239 (1959). The Andrews' reference describes copolymers obtained from dihydroxy compounds where one of the compounds is thiodiglycol.

U.S. Pat. No. 3,450,771 issued June 17, 1969 to Dombro describes organic sulfides that may be prepared by reacting a mercaptan, such as an n-octyl mercaptan, with an alcohol, such as methanol, in an alkaline medium. Dombro further describes his process as being useful in removing mercaptans from petroleum products.

In an article *Nucleophilic Substitution of Hydroxyl Groups in 2-Alkyl(Aryl)-Thioethanols,* published by Fokin et al in the Bull. Acad. Sci. U.S.S.R. Div. Chem. Sci. 1982, Page 1667, there is described the homocondensation of 2-alkylthioethanols. It is also disclosed in the Fokin paper that the 2-alkylthioethanol may be reacted with an alcohol to give a product containing both sulfur and ether linkages. Aromatic sulfur-containing compounds containing beta-hydroxy groups and their reaction properties are also discussed in the Fokin article. The Fokin paper does not discuss any particular utility or special advantage for the compositions described therein.

Musser and Koch in U.S. Pat. No. 4,031,023 issued June 21, 1977 describe lubricating compositions which utilize hydroxy thioethers, methods of using these materials in lubricating compositions, and additive concentrates for forming such lubricant compositions. The compositions of Musser and Koch show terminal mercaptan and terminal hydroxy groups thereon.

It has been determined in accordance with the present invention that various products may be prepared from thiodialkanols which are reacted with a mercaptan. It is further described herein that beta-thiodialkanols may be polymerized, and the terminal hydroxyl groups on the polymerized thiodialkanol capped with the mercaptan as is later described.

The compositions of the present invention are particularly effective as anti-oxidants in lubricant compositions, and are capable of functioning in specialized uses as a lubricant per se with exceptional anti-oxidant properties.

Throughout the specification and claims, percentages and ratios are by weight, temperatures are in degrees Celsius, and pressures are expressed in KPa gauge unless otherwise indicated.

SUMMARY OF THE INVENTION

The present invention describes a composition which is the reaction product of at least two equivalents of a mercaptan containing at least 5 carbon atoms and at least two equivalents of a beta-thiodialkanol.

A further embodiment of the invention is a composition of the formula $$RS(AS_xAO)_yAS_xASR^1$$

wherein x is 1 or greater, y is 0 or greater and R and $R^1$ are hydrocarbyl groups, A is an alkylene group and provided further that one of R and $R^1$ contains at least 5 carbon atoms.

The compositions of the present invention are conveniently employed in an automatic transmission fluid, or in a minor amount with a major amount of an oil of lubricating viscosity.

DETAILED DESCRIPTION OF THE INVENTION

The first aspect of the present invention are the mercaptans which are used herein. Mercaptans are a group of organo sulfur compounds that are derivatives of hydrogen sulfide in the same way that alcohols are derivatives of water. Mercaptans are also referred to generally as thiols. Mercaptans characteristically have a -SH group in the molecule.

In the present invention it is first preferred that the mercaptan be a single thiol or -SH group. The mercaptans may be aliphatic in nature and generally have the formula $$R(SH)_z$$

The value of z is typically one and is preferred in order to prevent further polymerization reactions. The mercaptan is highly reactive in the present invention, and the mercaptan (SH) condenses with the hydroxyl group from the thiodialkanol as later described to form the desired product and water.

The mercaptan $R(SH)_z$ is conveniently a material which has the hydrocarbyl group, R, (or $R^1$)as either an aliphatic or aromatic material which at least gives the product an oil-dispersible or oil-soluble character.

Where the mercaptan is aliphatic material, it will typically contain from about 2 to about 24 carbon atoms, preferably from about 4 to about 18 carbon atoms. Examples of the mercaptans include materials such as methyl mercaptan, ethyl mercaptan, propyl mercaptan, n-butyl mercaptan, n-pentyl mercaptan, and the various isomers of these compounds. Further mercaptans include dodecyl mercaptan. An example of an aromatic mercaptan is thiophenol. Further useful mercaptans herein include heterocycles containing pendant (-SH) groups such as mercaptothiadiazoles and mercaptobenzothiazole. It is very desirable in the present invention that the mercaptan be substantially free of hydroxyl groups such that the reaction product of the beta-thiodialkanol and the mercaptan is also substantially free of hydroxyl groups.

The second component of the present invention is a thiodialkanol. Preferably, the thiodialkanol is a betathiodialkanol indicating that the sulfur molecule forming the sulfide linkage is located two carbon atoms from one or both of the hydroxyl groups.

The beta-thiodialkanol is described by the formula $HOR^2(S)_xR^3OH$ (I) allows substantially any group of substituents between the hydroxyl group and the sulfur provided that two carbon atoms intervene between the sulfur and the oxygen.

In a preferred state, $R^2$ and $R^3$ are each $—CHR^4CHR^5—$. Where both $R^4$ and $R^5$ are hydrogen, an ethylene group exists. Of course, $R^4$ and $R^5$ may be any non-interfering hydrocarbyl group. A hydrocarbyl group as defined herein is a moiety containing hydrogen and carbon and any other non-interfering atoms. Preferably $R^4$ or $R^5$ are limited to hydrogen or lower straight chain alkyl groups such as methyl or ethyl. It is noted, that if a t-butyl group is inserted in the molecule as $R^4$ or $R^5$, the condensation reaction to form the polymer is particularly hindered. However, a styrene residue is non-interfering and may be used as $R^2$ or $R^3$.

The beta-thiodialkanol preferably contains only one sulfur atom per repeating unit, i.e., x is 1. However, it is acceptable and under some conditions desirable to have x at a value of 2 thereby having a disulfide structure in the molecule. It is also possible to have compositions where there are mixtures of monosulfide and disulfide. For an automatic transmission fluid, the monosulfide is desired. In lubricating oils for engines, some disulfide is desired to provide anti-wear as well as anti-oxidant properties.

Further, with regard to the structural formula given above, the value of y is stated to be 0 or greater, preferably from about 1 to about 5 for polymers, and most preferably from about 1 to about 3. Such polymerization is obtained by using at least an equivalent excess of the thiodialkanol. The polymerization of the thiodialkanol may be done independently of its introduction to the mercaptan, or may be conducted in situ, e.g., a one-pot reaction where the thiodialkanol and the mercaptan are present simultaneously. If it is desired to obtain the product where y is 0, the mercaptan is introduced to the pot, followed by slowly introducing the thiodialkanol. Where longer polymers are desired, e.g., y is a large number, it is possible to prepolymerize the thiodialkanol and to introduce the mercaptan at a later point.

Further, with regard to the above described structural formula, it is desirable that one of R or $R^1$ is an aliphatic group. A further desirable variation is where one of R or $R^1$ is an aromatic group. Where R or $R^1$ is an aliphatic group, it is desirable that the aliphatic group contain from about 4 to about 18, preferably 6 to 18 carbon atoms.

As previously noted, it is highly desired that the product be capped with the mercaptan residue (RS or $R^1S$)as shown in the Summary. This is typically done by preparing the product such that there are two equivalents of the mercaptan for each two equivalents of the thiodialkanol. As the thiodialkanol is a difunctional material, it will react with one equivalent of a monomercaptan at each end of the thiodiglycol molecule to liberate two equivalents of water, thereby giving the desired reaction product. As the mercaptan reacts somewhat slower than the thiodialkanol polymerizes, it is possible to use two equivalents of the mercaptan and a substantially greater number of equivalents of the thiodialkanol to obtain the desired reaction product. The equivalent weight of the thiodialkanol is one-half of its molecular weight.

The mercaptan and the thiodialkanol are conveniently reacted in a suitable reaction vessel which is constructed with a trap due to the odoriferous nature of the mercaptan. It is desirable that any unreacted mercaptan be scavenged or scrubbed out of the reaction product following the reaction to avoid any unpleasant odors in the work area. It is, of course, possible to include small amounts of the mercaptan or the thiodialkanol or the polymerized thiodialkanol in the final product for use in the later described lubricants.

The temperature conditions for conducting the reaction are typically between about 50° C. to about 200° C., preferably from about 100° C. to about 150° C. The reaction mixture is conveniently stirred at a moderate rate in order to facilitate full mixing of the ingredients to insure complete reactivity. The reaction is preferably acid catalyzed. Suitable acids are those mineral acids such as sulfuric or phosphoric or an organic acid such as para-toluene sulfonic acid. The catalyst need not be removed from the final product; however, if such is desired, the catalyst may be removed by base treatment and filtration.

The compositions of the present invention are useful in various lubricating products and in particular in motor vehicle lubricants. The lubricants typically contain a lubricant base material which is an oil lubricating viscosity such as further described below. The products obtained herein are peroxide decomposers and metal chelators.

Unrefined, refined and rerefined oils (and mixtures of each with each other) of the type disclosed hereinabove can be used in the lubricants and functional fluids of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

The synthetic lubricating oils useful herein include hydrocarbon oils and halosubstituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodceylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyiso-propylene glycol ether having an average molecular weight of about 100, diphenyl ether of polyethylene glycol having a molecular weight of about 500–1000, diethyl ether of polypropylene glycol having a molecular weight of about 1000–±500, etc. or mono- and polycarboxylic esters thereof, for example, the acetic acid esters, mixed $C_3$–$C_8$ fatty acids esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phathalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy- or polyaryloxy-siloxane oils and silicate oils comprise another useful class of synthetic lubricants (e.g., tetraethyl silicate, tetraisopropyl silicate tetra-(2-ethylhexyl) silicate, tetra-(4-methyl-hexyl) silicate, tetra-(p-tert-butylphenyl)silicate, hexyl-4-methyl-2-pentoxy)disiloxane, poly(methyl)siloxanes, poly(methylphenyl)siloxanes, etc.). Other synthetic lubricating oils include liquid esters of phosphorus containing acids (e.g., tricresyl phosphate, trioctyl phosphate, diethyl ester of decane phosphoric acid, etc.), polymeric tetrahydrofurans and the like.

Polyolefin oligomers are typically formed by the polymerization reaction of alpha-olefins. Nonalphaolefins may be oligomerized to give a synthetic oil within the present invention, however, the reactivity and availability of alpha-olefins at low cost dictates their selection as the source of the oligomer.

The polyolefin oligomer synthetic lubricating oils of interest in the present invention include hydrocarbon oils and halo-substituted hydrocarbon oils such as are obtained as the polymerized and interpolymerized olefins, e.g., oligomers, include the polybutylenes,polypropylenes, propylene-isobutylene copolymers, chlorinated polybutylenes, poly(1-hexenes), poly(1-octenes), poly(1-decenes), similar materials and mixtures thereof.

Typically, the oligomer is obtained from a monomer containing from about 6 to 18 carbon atoms. Most preferably, the monomer used to form the oligomer is decene, and preferably 1-decene. The nomenclature alpha-olefin is a trivial name and the IUPAC nomenclature of a 1-ene compound may be considered to have the same meaning within the present invention.

While it is not essential that the oligomer be formed from an alpha-olefin, such is desirable. The reason for forming the oligomer from an alpha-olefin is that branching will naturally occur at the points where the olefin monomers are joined together, and any additional branching within the backbone of the olefin can provide too high a viscosity of the end oil. It is also desirable that the polymer formed from the alpha olefin be hydrogenated. The hydrogenation is conducted according to known practices. By hydrogenating the polymer, free radical attack on the allyic carbons remaining after polymerization is minimized.

Additional materials which are desirably added to the hydrocarbon based fluids are as follows: Viscosity improving materials may be included in the compositions of the present invention. The viscosity index improvers typically include polymerized and copolymerized alkyl methacrylates and mixed esters os styrene-maleic anhydride interpolymers reacted with nitrogen-containing compounds.

Polyisobutylene compounds are also typically used as viscosity index improvers. The amount of viscosity improver which may be typically added to the fully formulated manual transmission fluid composition is about 1% to about 50%, preferably about 10% to about 25% by weight.

Zinc salts are also added to manual transmission lubricants. Zinc salts are ordinarily utilized as extreme pressure agents such as zinc dithiophosphates. The zinc salts are added at levels measured by weight of the zinc metal at from about 0.02% to about 0.2%, preferably from about 0.04% to about 0.15% by weight.

Additional ingredients which may be included in a transmission fluid are fatty acid amides which are useful as additional friction modifiers, particularly for reducing the static coefficient of friction. Further useful components herein include seal swell agents such as sulfones and sulfolanes. Suitable seal swell agents are disclosed in U.S. Pat. No. 4,029,587 to Koch issued June 14, 1977. A still further useful component in the present invention is a foam suppression agent such as a silicone oil. Any other typical ingredient may be included herein such as pour point depressants, dyes, odorants and the like.

Additional components which are typically used in transmission fluids, motor oils or hydraulic fluids include the following.

Extreme pressure agents and corrosion and oxidation-inhibiting agents which may be included in the compositions of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and bsulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Many of the above-mentioned extreme pressure agents and corrosion-oxidation inhibitors also serve as anti-wear agents. Zinc dialkylphosphorodithioates are a well known example.

Anti-wear agents that are particularly useful in the hydraulic fluid compositions of the invention are those obtained from a phosphorus acid of the formula $(R'O)2PSSH$, wherein each R' is independently a hydrocarbon-based group, or the phosphorus acid precursors thereof with at least one phosphite of the formula $(R''O)_3P$, R'' is a hydrocarbon-based group, under reaction conditions at a temperature of about 50° C. to about 200° C. R' is preferably an alkyl group of about 3 to about 50 carbon atoms, and R'' is preferably aromatic. The salt is preferably a zinc salt, but can be a mixed salt of at least one of said phosphorus acids and at least one carboxylic acid. These anti-wear agents are described more fully in U.S. Pat. No. 4,263,150, which is incorporated herein by reference. These anti-wear agents as well as the anti-wear agents referred to above can be provided in the compositions of the invention at levels of about 0.1% to about 5%, preferably about 0.25% to about 1% by weight based on the total weight of said fluid compositions.

Additional oxidation inhibitors that are particularly useful in the fluid compositions of the invention are the hindered phenols (e.g., 2, 6-di-(t-butyl)phenol); aromatic amines (e.g., alkylated diphenyl amines); alkyl polysulfides; selenides; borates (e.g., epoxide/boric acid reaction products); phosphorodithioic acids, esters and/or salts; and the dithiocarbamate (e.g., zinc dithiocarbamates). These oxidation inhibitors as well as the oxidation inhibitors discussed above are preferably present in the fluids of the invention at levels of about 0.05% to about 5%, more preferably about 0.25 to about 2% by weight based on the total weight of such compositions.

The rust-inhibitors that are particularly useful in the compositions of the invention are the alkenyl succinic acids, anhydrides and esters, preferably the tetrapropenyl succinic acids, acid/esters and mixtures thereof; metal (preferably calcium and barium) sulfonates; the amine phosphates; and the imidazolines. These rust-inhibitors are preferably present at levels of about 0.01% to about 5%, preferably about 0.02% to about 1% by weight based on the total weight of the product.

Pour point depressants may be included in the compositions described herein. The use of such pour point depressants in oil-based compositions to improve low temperature properties of oil-based compositions is well known in the art. See, for example, page 8 of "Lubricant Additives" by C. V. Smalheer and R. Kennedy Smith (LeziusHiles Co. Publishers, Cleveland, Ohio 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878 and 3,250,715 which are hereby incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Kerner (Noyes Data Corporation, 1976), pages 125–162.

UTILIZATION OF THE COMPOSITION

The composition of the present invention is typically used in the automatic transmission fluid, hydraulic fluid, functional fluid or lubricating oil composition at a level of about 0.025% to about 5%, preferably from about 0.1% to about 2% by weight. As the products of the invention are oleophilic, the blending of the products is relatively simple. Where the compositions of the present invention are intended for use in an aqueous based material, it is desirable to include such adjuvants and other materials as may be necessary to stably disperse the active ingredients in the aqueous formulation. When an aqueous composition is utilized, it is typically up to 85% and preferably up to 90% water with the remainder being the active ingredient of this invention and other materials typically placed in such aqueous formulations.

The following are examples of the present invention.

EXAMPLE I

A suitable reaction vessel is prepared and 2 moles of n-dodecyl mercaptan is added with 400 mls. of toluene. Five grams of para-toluene sulfonic acid catalyst is added to the reaction mixture. The reaction mixture is heated to reflux under nitrogen and one mole of thiodiglycol is introduced dropwise over a period of approximately 2 hours. The reaction is continued until no further water is evolved.

The acid catalyst is neutralized with 50% aqueous caustic and the solvent is removed under reduced pressure. The reaction product is then filtered at 80° C. and the filtrate is recovered as the product.

EXAMPLE II

A product is prepared from a mixture of mercaptans. One mole of mercaptobenzthiazole, one mole of dodecyl mercaptan and 400 mls. of toluene are added to the reaction vessel. The reaction mixture is heated to reflux and 5 grams of sulfuric acid catalyst are added. With continued heating and stirring, one mole of thiodigylcol is added incrementally over a period of approximately 2 hours. The reaction is continued until no more water is evolved.

The solvent is removed under reduced pressure and the product is filtered. The filtrate is the recovered product.

EXAMPLE III

To a suitable reaction vessel is added 2 moles of thiodigylcol, 2 moles of thiophenol, 400 mls. of toluene and 5 grams of sulfuric acid catalyst. The reaction mixture is heated to reflux and the reaction is continued until no further water is evolved.

The acid catalyst is neutralized with 50% aqueous caustic and the solvent is removed under reduced pressure. The product is then filtered and the filtrate is recovered as the product.

EXAMPLE IV

A series of automatic transmission fluids without conventional antioxidants are prepared and labeled as A, B and C. The three products (A, B and C) are separately combined at 100 parts with 1 part of the reaction product of Examples I–III.

A fourth automatic transmission fluid is prepared as D. The product D is the same as A, however, 1 part of octylated diphenylamine is added as an additional antioxidant.

The compounds of the invention perform exceptionally well as anti-oxidants in the automatic transmission fluids. As a further variation of the invention an automatic transmission fluid is formulated as in Example B except that the thiodiglycol component of the antioxidant is replaced by the corresponding disulfide.

What is claimed is:

1. A compound of the formula $$RS(AS_xAO)_yAs_xASR^1$$

wherein x is 2, y is 0 and R and $R^1$ are hydrocarbyl groups, A is an alkylene group and provided further that one of R and $R^1$ contains at least 5 carbon atoms and is derived from a mercaptothiadiazole or mercaptobenzothiazole.

2. The composition of claim 1 wherein A is an ethylene group.

3. The compound of claim 1 wherein one of R and $R^1$ is derived from a mercaptothiadiazole.

4. The compound of claim 1 wherein one of R and $R^1$ is derived from a mercaptobenzothiazole.

5. An automatic transmission fluid comprising a suitable base fluid for an automatic transmission and a compound of the formula $$RS(AS_xAO)_yAS_xASR^1$$

wherein x is 2, y is 0 and R and $R^1$ are hydrocarbyl groups, A is an alkylene group and provided further that one of R and $R^1$ contains at least 5 carbon atoms and is derived from a mercaptothiadiazole or mercaptobenzothiazole.

6. The automatic transmission fluid of claim 5 wherein one of R and $R^1$ is derived from a mercaptothiadiazole.

7. The automatic transmission fluid of claim 5 wherein one of R and $R^1$ is derived from a mercaptobenzothiazole.

* * * * *